US007066125B2

(12) United States Patent
Lieberman

(10) Patent No.: US 7,066,125 B2
(45) Date of Patent: Jun. 27, 2006

(54) FROST PLUG ADAPTER ASSEMBLY

(75) Inventor: David Lieberman, Concord (CA)

(73) Assignee: Active Gear Co of Canada Limited, Concord (CA)

( * ) Notice: Subject to any disclaimer, the term of this patent is extended or adjusted under 35 U.S.C. 154(b) by 0 days.

(21) Appl. No.: 11/069,956

(22) Filed: Mar. 3, 2005

(65) Prior Publication Data

US 2006/0112908 A1 Jun. 1, 2006

(30) Foreign Application Priority Data

Nov. 30, 2004 (CA) ..... 2488718

(51) Int. Cl.
*F02N 17/02* (2006.01)

(52) U.S. Cl. ..... 123/142.5 E; 219/208; 123/142.5 R

(58) Field of Classification Search ..... 123/21, 123/41.5, 142.5 E, 142.5 R; 219/201, 205, 219/208; 220/235, 243, 248
See application file for complete search history.

(56) References Cited

U.S. PATENT DOCUMENTS

| | | | | |
|---|---|---|---|---|
| 3,727,638 A | | 4/1973 | Zaremba, Jr. et al. | |
| 4,242,564 A | * | 12/1980 | Kendall | 219/208 |
| 4,851,640 A | | 7/1989 | Smith | |
| 6,113,072 A | | 9/2000 | Wickett | |

FOREIGN PATENT DOCUMENTS

| | | |
|---|---|---|
| CA | 963518 | 2/1975 |
| CA | 1135757 | 11/1982 |
| CA | 2123962 | 11/1995 |
| CA | 2238938 A1 | 6/1997 |

OTHER PUBLICATIONS

DEFA WarmUp—Technical Handbook—pp. 19 to 34—Online 2003.

* cited by examiner

*Primary Examiner*—Tony M. Argenbright
*Assistant Examiner*—Katrina Harris
(74) *Attorney, Agent, or Firm*—Riches, Mc Kenzie & Herbert LLP

(57) ABSTRACT

A frost plug adapter assembly having a locking mechanism that provides a positive capture through an existing frost plug aperture. A cylindrical body is engaged within a frost plug aperture and is maintained in place by a bolt, a locking element and a wing nut. The bolt is advantageously positioned through the cylindrical body with a bolt head at the outer end. The wing nut is screwed onto a threaded end of the bolt so that the wings engage channels of arms of the locking element to spread the arms until they contact an inner annulus of the frost plug aperture. The frost plug adapter assembly is also capable of providing access to engine fluid by providing channels through the inner end of the cylindrical body. The frost plug adapter assembly is easy to install and the locking mechanism prevents the assembly from falling out under severe conditions.

9 Claims, 3 Drawing Sheets

FROST PLUG ADAPTER ASSEMBLY

FIELD OF THE INVENTION

This invention relates to a frost plug adapter assembly which has a locking mechanism and is capable of providing engine water access.

BACKGROUND OF THE INVENTION

It is common practice in the construction of liquid cooled internal combustion engines to cast the cylinder block and its water jacket as a single piece. Because the cylinder block and water jacket are one piece, apertures are provided in the walls of the water jacket to permit the removal of sand at the end of the casting procedure. When the engines are assembled, these apertures are then closed with plates or plugs.

It is common practice to insert a "frost plug" into at least one of these apertures. A frost plug is a device which is generally used to determine the liquid level when the contents of a tank are at a temperature below 0° C. The apertures or holes in the water jacket have thus become known as "frost plug apertures".

It is also known to replace a frost plug with a heating element insertable into a frost plug aperture. Generally, these "frost plug heaters" take the form of a disc-shape body member and have a heating element that extends within the water jacket to keep the engine temperature heated to an acceptable level during cold weather.

In an effort to simplify the process for mounting the frost plug heater onto the engine block and its removal, U.S. Pat. No. 4,851,640 to Smith discloses a frost plug heater that has a cylinder body insertable in a frost plug aperture. The cylinder body is held in place by passing a screw through a bore of the cylinder and securing a yoke to an end of the screw. The head of the screw is located on the outside of the cylinder with the yoke being insertable through the frost plug aperture by tilting the yoke on the screw. Once inserted into the frost plug aperture, the yoke is straightened so that the yoke straddles the aperture with ends of the yoke in contact with the inner circumference of the aperture.

A drawback of this attachment apparatus is that it is difficult for a user to install this frost plug heater quickly given the accuracy required for proper installation and the space constraints of the engine compartment. This is because the yoke has an overall length longer than a diameter of the frost plug aperture and proper tilting of the yoke is required to insert it into the aperture. Installation requires significant manual dexterity of a user and can be very difficult and time consuming depending on the casting wall thickness and the special limitations within the coolant cavity.

The attachment apparatus of the frost plug heater disclosed in Smith also suffers the disadvantage of working loose under engine operating conditions thereby increasing the risk of the frost plug heater falling out of place and causing damage to the engine.

Another frost plug heater is disclosed in U.S. Pat. No. 4,242,564 to Kendall. Kendall also teaches a clamping structure for securing a frost plug heater in a frost plug aperture. The frost plug immersion heater disclosed in Kendall comprises a clamp element having a base engagable against the inner end of the heater body and a pair of channel-shaped clamping arms extending in splayed relation from the sides of the base. A special T-shaped bolt has opposite ends engaging the arms to spread the clamp arms when a nut is threaded on the outer end portion of the T-shaped bolt and is tightened against the outer end of the heater body.

The frost plug heater taught by Kendall suffers the disadvantage of having the nut on the outside of the cylindrical body which makes the frost plug heater body susceptible to loosening by vibration. Also, the nut is exposed to extreme temperature fluctuations and moisture making it susceptible to rust and possible shearing of the bolt leading to failure of the attachment means. This increases the instance of the frost plug heater falling out and causing damage to the engine. Also, because the nut is positioned on the outside of the cylindrical body, the nut and an end portion of the bolt project into the engine compartment. Not only is this a disadvantage from an aesthetic standpoint, but the inability to obtain a "low profile" attachment poses a functional disadvantage where space in an engine compartment is limited.

The attachment mechanism of the frost plug heater of Kendall is also more costly to manufacture from both a materials and labour standpoint as a custom T-shaped bolt is required.

SUMMARY OF THE INVENTION

The present invention is directed to a frost plug adapter assembly. The frost plug adapter assembly enables a user to remove a frost plug from an aperture and replace it with an assembly that has a locking mechanism and which is also advantageously capable of providing engine fluid access. The frost plug adapter assembly of the present invention has a locking mechanism that provides a positive capture through the existing opening for a frost plug. This positive capture prevents the frost plug adapter assembly from dislodging even under severe applications and conditions such as temperature fluctuations and vibration. The present invention is also advantageous for providing heater cores, fuel-fired heaters, and coolers with access to the engine water circuit.

It is an object of this invention to overcome the designs of prior art devices which result in unstable solutions with increased potential for the frost plug falling out of place and causing damage to an engine.

It is a further object of the present invention to provide a frost plug adapter assembly which is easy to install and therefore less damage to the frost plug adapter assembly is likely to be encountered during installation, thereby increasing productivity during installation and overall cost-effectiveness, as a result.

The present invention is further advantageous as the frost plug adapter assembly is scalable to meet different size requirements, as various engines have different diameter frost plug apertures.

In one embodiment, the present invention resides in a frost plug adapter assembly comprising: a substantially cylindrical body having an inner end and an outer end, the inner end having an end face with a recessed cavity, and a portion of the inner end having a diameter less than a diameter of a frost plug aperture, the portion of the inner end also having a seal to prevent fluid from exiting at an annular circumference of an inner side of the frost plug aperture when the portion of the inner end is secured within the frost plug aperture, whereby a portion of the cylindrical body has a diameter greater than the diameter of the frost plug aperture which is engagable with an annular circumference of an outer side of the frost plug aperture, the frost plug adapter assembly also having a locking element with a central portion sized to fit within the recessed cavity, the central portion having a hole therethrough and two arms integrally attached to the central portion and disposed opposite one another in a substantially co-planar alignment, each arm having two flanges, and each flange being disposed longitudinally along each side of each arm to provide channels, the two arms are each angled from a same side of the central portion at an oblique angle to a plane through the central portion whereby a distance between free ends of the arms before the portion of the inner end is inserted into the frost plug aperture is less than a diameter of the frost plug aperture, and the two arms being spreadable so that the distance between the free ends of the arms is greater than the diameter of the frost plug aperture after the portion of the inner end is inserted into the frost plug aperture, whereby, to secure the portion of the inner end of the cylindrical body within the frost plug aperture, a bolt is positionable through a longitudinal bore in the cylindrical body having a head of the bolt disposed at the outer end of the cylindrical body and the locking element is positioned on a threaded end of the bolt with the central portion disposed in the recess and the arms projecting away from the end face, and a wing nut is threadably secured to the threaded end whereby the wing nut has a central threaded nut and two wings integrally attached to the threaded nut and disposed opposite each other in a co-planar alignment, the wings being sized so as to be positionable within the channels of the arms whereby the tightening of the wing nut onto the threaded end of the bolt causes the free ends of the arms of the locking element to spread in a direction away from each other and towards the plane through the central portion to engage an inner circumference of the frost plug aperture.

In another embodiment, the present invention resides in a frost plug adapter assembly comprising: a substantially cylindrical body having an inner and outer end, and having at least one internal cavity allowing a flow of fluid through the cylindrical body; the cylindrical body also having a portion of the inner end being sized to fit within a frost plug hole and having a rib engagable with an outer circumferential rim of the frost plug hole, and a recess positioned circumferentially on the cylindrical body between an end face of the inner end and the flange, an O-ring gasket positionable within the recess to form a seal when the inner end is engaged within the frost plug hole, the frost plug adapter assembly also having a positive capture apparatus comprising a locking element having a central portion with an aperture and two arms integrally attached to the central portion, the two arms being angled with a distance between free ends of the arms less than a diameter of the frost plug hole, and a bolt positionable through the cylindrical body and locking element and threaded to receive a wing nut, the wing nut being positionable within the flanges of the arms whereby the tightening of the wing nut onto the threaded bolt causes the free ends of the arms of the locking element to spread away from each other.

Further and other features of the invention will be apparent to those skilled in the art from the following detailed description of the embodiments thereof.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 1:
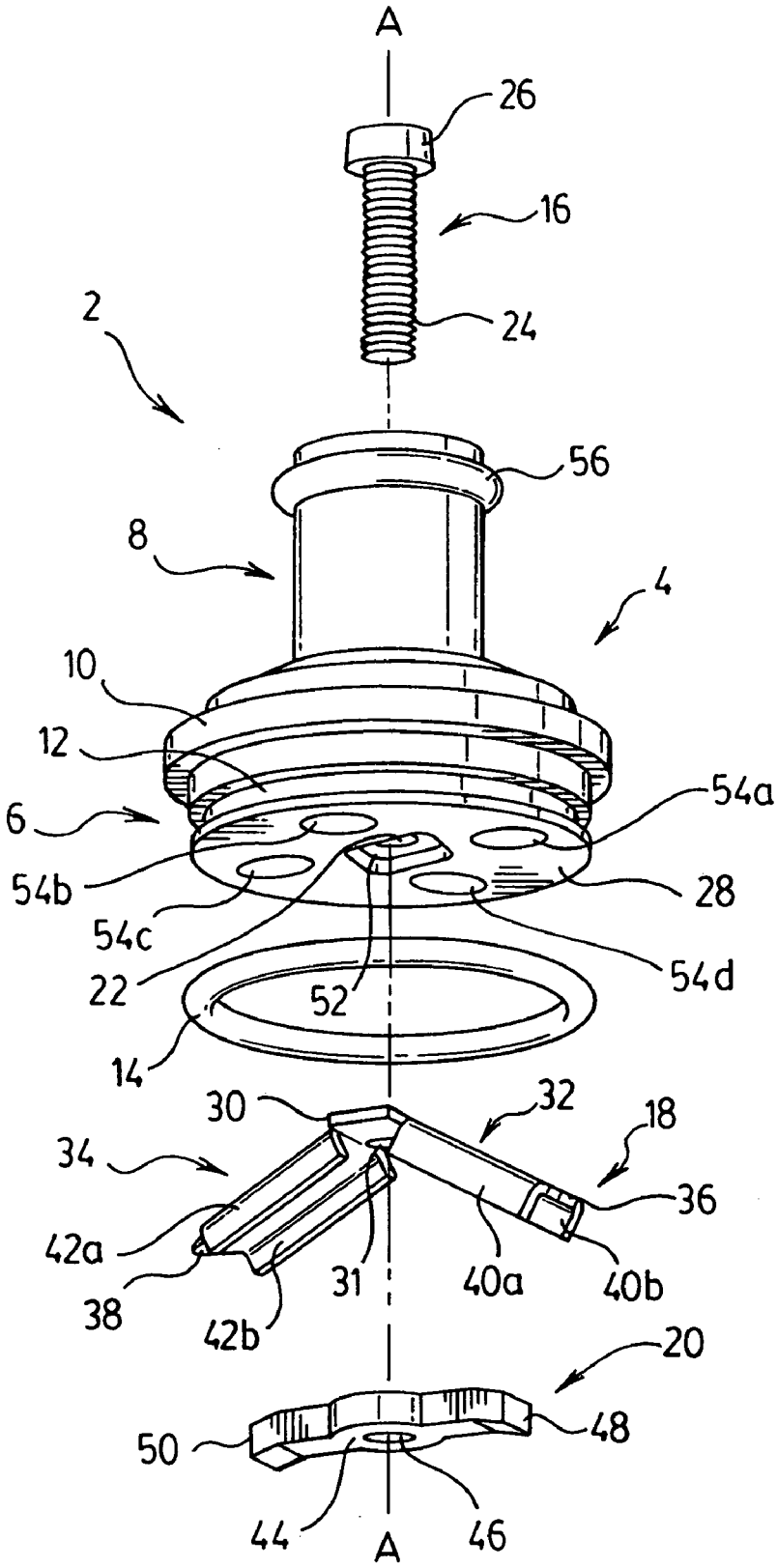
FIG. 1 shows an exploded view of the frost plug adapter assembly with the outer end having a hose barb.

Reference may now be had to FIG. 1 which illustrates a frost plug adapter assembly 2 in accordance with a preferred embodiment of the invention. The frost plug adapter assembly 2 has a substantially cylindrical body 4 having a disc-like inner end 6 and a right circular cylindrical outer end 8. As shown, the inner end 6 has a diameter greater than a diameter of the outer end 8. In a most preferred embodiment, the cylindrical body 4 is 1.27 inches in length.

The diameter of the inner end 6 is slightly less than a diameter of a frost plug aperture, so that the inner end 6 is insertable into the aperture (not shown). As shown on FIG. 1, an annular rib 10 is positioned circumferentially around the cylindrical body 4 and has a diameter greater than the diameter of the frost plug aperture. When the inner end 6 is inserted into the frost plug aperture, the rib engages an outer circumferential rim of the frost plug aperture to prevent the cylindrical body 2 from being inserted further into the aperture.

In a most preferred embodiment, the diameter of the inner end 6 is 1.57 inches at an end face 28. The diameter of the inner end 6 at the annular rib is greater than 1.57 inches, and preferably the annular rib has a thickness of 0.16 inches in a longitudinal direction of the cylindrical body 4.

A seal is provided to prevent fluid from exiting around the circumference of the frost plug aperture once the inner end 6 is inserted into the aperture. In the embodiment shown on FIG. 1, an annular recess 12 is positioned circumferentially on the inner end and the recess 12 is indented to receive an O-ring gasket 14. The O-ring gasket 14 is preferably formed of elastic rubber, and is sized to have a same diameter as an innermost portion of the annular recess 12 so that the O-ring gasket fits snugly around the inner end 6 and is held within the recess 12. When the inner end 6 is inserted in the aperture, the O-ring gasket engages the annular circumference of the aperture to fluidly seal the frost plug aperture from an inner side of the aperture. Preferably, the annular recess has a width of 0.14 inches and extends a depth of 0.11 inches into the inner end 6. To fluidly seal the inner circumference of the aperture, the annular recess 12 is preferably provided 0.05 inches from an end face 28 of the inner end 6 in a direction towards the outer end 8.

Figure 3:
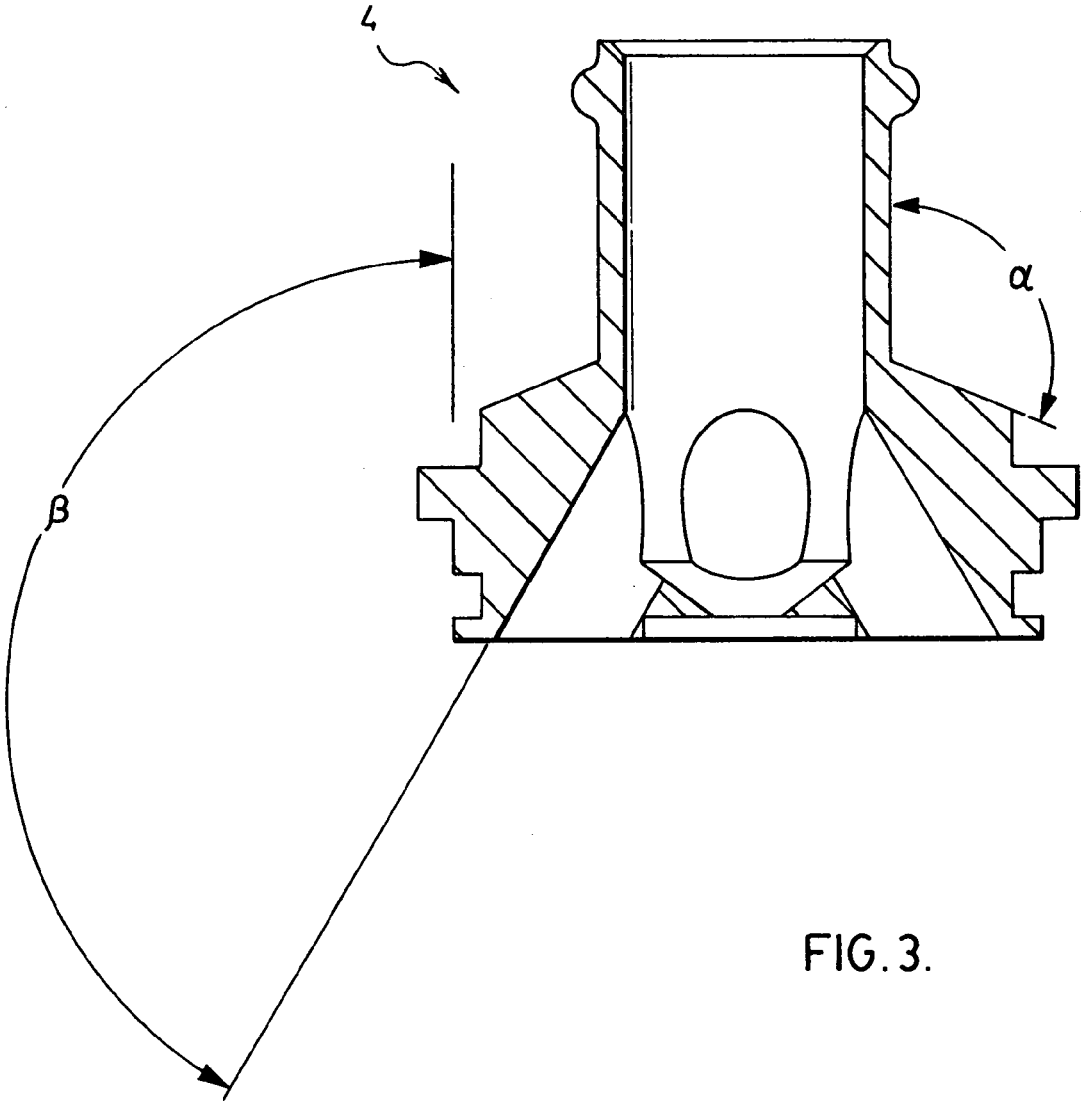
FIG. 3 shows a sectional view of the cylindrical body shown on FIG. 1, taken along axis A—A.

As shown in FIG. 1, the outer end 8 is a hollow right circular cylinder and preferably has an outer diameter of 0.71 inches and an inner diameter of 0.56 inches, and a preferred wall thickness of 0.12 inches. In a most preferred embodiment, the outer end 8 has a height of 0.75 inches. The inner end 6 is integrally formed with the outer end 8. In a most preferred embodiment, the disc-like inner end 6 is tapered at a region where it meets the right circular cylindrical outer end 8. As shown on FIG. 3, the inner end 6 meets the outer end 8 at an angle $\alpha$ offset to the perpendicular wall of the outer end 8. In a most preferred embodiment, $\alpha$ is equal to 95–115 degrees.

To secure the inner end 6 of the cylindrical body 4 within the frost plug aperture, a bolt 16, a locking element 18 and a wing nut 20 are provided. As is best shown in the exploded view in FIG. 1, the bolt 16 is inserted through an internal cavity 22 extending through a central longitudinal axis A—A of the cylindrical body 4. Preferably, the bolt is a conventional bolt having a threaded end 24 and slotted head 26. The bolt 16 is inserted into the cavity 22 with the threaded end 24 extending through the inner end 6 to project past the end face 28 of the inner end 6. The locking element 18 is then positioned on the threaded end 24 and the wing nut 20 is threadably secured to the threaded end 24.

The locking element 18 consists of a central portion 30 and two angled arms 32, 34. As shown in FIG. 1, the two arms 32, 34 are integrally formed with the central portion 30. The central portion has a hole 31 centrally disposed thereon. The arms 32, 34 are positioned at substantially equal and opposing oblique angles to a plane extending through the central portion 30. As shown on FIG. 1, each arm 32, 34 is angled to a same side of the plane. By positioning the arms 32, 34 at such opposing angles, free ends 36, 38 of the arms 32, 34, respectively, are spaced from each other at a distance less than the diameter of the frost plug aperture. This allows the cylindrical body 4 to be inserted straight into the frost plug aperture with the central axis A—A perpendicular to the diameter of the frost plug aperture and without requiring any tilting of the cylindrical body 4.

Also shown on FIG. 1, flanges 40*a*, 40*b* and 42*a*, 42*b* are provided on the arms 32, 34, respectively, and form channels. In a preferred embodiment, the flanges 40*a*, 40*b* and 42*a*, 42*b* are formed by bending edge portions of the material forming the arms 32, 34, respectively, at a right angle.

As shown on FIG. 1, the wing nut 20 has a central nut portion 44 which has a centrally disposed threaded throughbore 46. Wings 48, 50 are integrally formed to the central nut portion 44 and have a width sized to fit within the inner boundaries circumscribed by the flanges 40*a*, 40*b* and 42*a*, 42*b*. By this construction, the wings 48, 50 of the wing nut 20 are able to be fitted within the channels of the locking element 18.

The frost plug adapter assembly is fixed within the frost plug aperture by inserting the bolt 16 through the internal cavity 22 of the cylindrical body 4 and passing it through the hole 31 in the central portion 30 of the locking element 18 and then threadably securing the wing nut 20 to the bolt 16 with the wings 48, 50 fitted within the channels bordered by flanges 40*a*, 40*b* and 42*a*, 42*b*. The central portion 30 of the fastening element 18 is fitted within a recess 52 on the end face 28 of the inner end 6 of the cylindrical body 4. Preferably, the recess 52 is substantially rectangular with rounded corners and has a length of 0.56 inches and a width of 0.43 inches. Because the central portion 30 is of a corresponding dimension, the central portion 30 is fitted in the recess and rotation of the central portion 30 is prohibited.

By this construction, the tightening of the bolt 16 onto the wing nut 20 causes the arms 32, 34 to spread in a direction towards a plane extending through the central portion 30. By this straightening of the locking element 18, the inner end 6 of the cylindrical body 4 is secured within the frost plug aperture so that the free ends 36, 38 of the fastening element 18 engage an inner circumference of the frost plug aperture.

In a simplified embodiment, the depth of the inner end 6 of the cylindrical body 4, between the circumferential rib 10 and the end face 28, is approximately equal to or less than a thickness of the material surrounding the frost plug aperture. Thus, the free ends 36, 38 of the fastening element 18 are spreadable to engage the inner circumference of the frost plug aperture to thereby securely engage the circumferential rib 10 to the outer circumference of the frost plug aperture. By positioning the O-ring gasket 14 within the recess 12, the cylindrical body 4 is thereby secured to the frost plug aperture so that fluid and/or air are prohibited from leaking from the inner side of the frost plug aperture to the outer side of the frost plug aperture by a circumference of the aperture.

In a preferred embodiment, the frost plug adapter assembly is capable of providing engine fluid access. This is advantageous for providing heater cores, fuel-fired heaters, and coolers with access to the engine water circuit. In the embodiment shown on FIG. 1, cavities 54*a*, 54*b*, 54*c* and 54*d* are provided through the inner end 6 to allow fluid communication from the end face 28 to the hollow cylindrical outer end 8 of the cylindrical body 4. Preferably, the cavities 54*a*, 54*b*, 54*c* and 54*d* are spaced equidistant from each other and have a diameter equal to 0.32 inches. As shown on FIG. 3, the cavities 54*a*, 54*b*, 54*c* and 54*d* are positioned circumferentially around the internal cavity 22, and offset at an angle β from a line perpendicular to the axis A—A. In a most preferred embodiment shown on FIG. 3, the angle β is 150 degrees.

In the embodiment shown in FIG. 1, a hose barb 56 is disposed around an outermost end of the outer end 8, preferably 0.03 inches from the outermost end of the outer end 8 in a direction towards the inner end 6. The hose barb 56 is a semi-circular protrusion encircling a circumference of the outer end to form a rounded rib or annulet. Preferably, the hose barb 56 has a radius of 0.08 inches. A hose (not shown) can be fitted over the outer end 8 and is held on the outer end 8 by a friction fit of the hose barb 56 on an inner circumference of the hose. Preferably, the hose has an inner diameter substantially the same as or slightly larger than the outer diameter of the cylindrical outer end 8.

Figure 2:
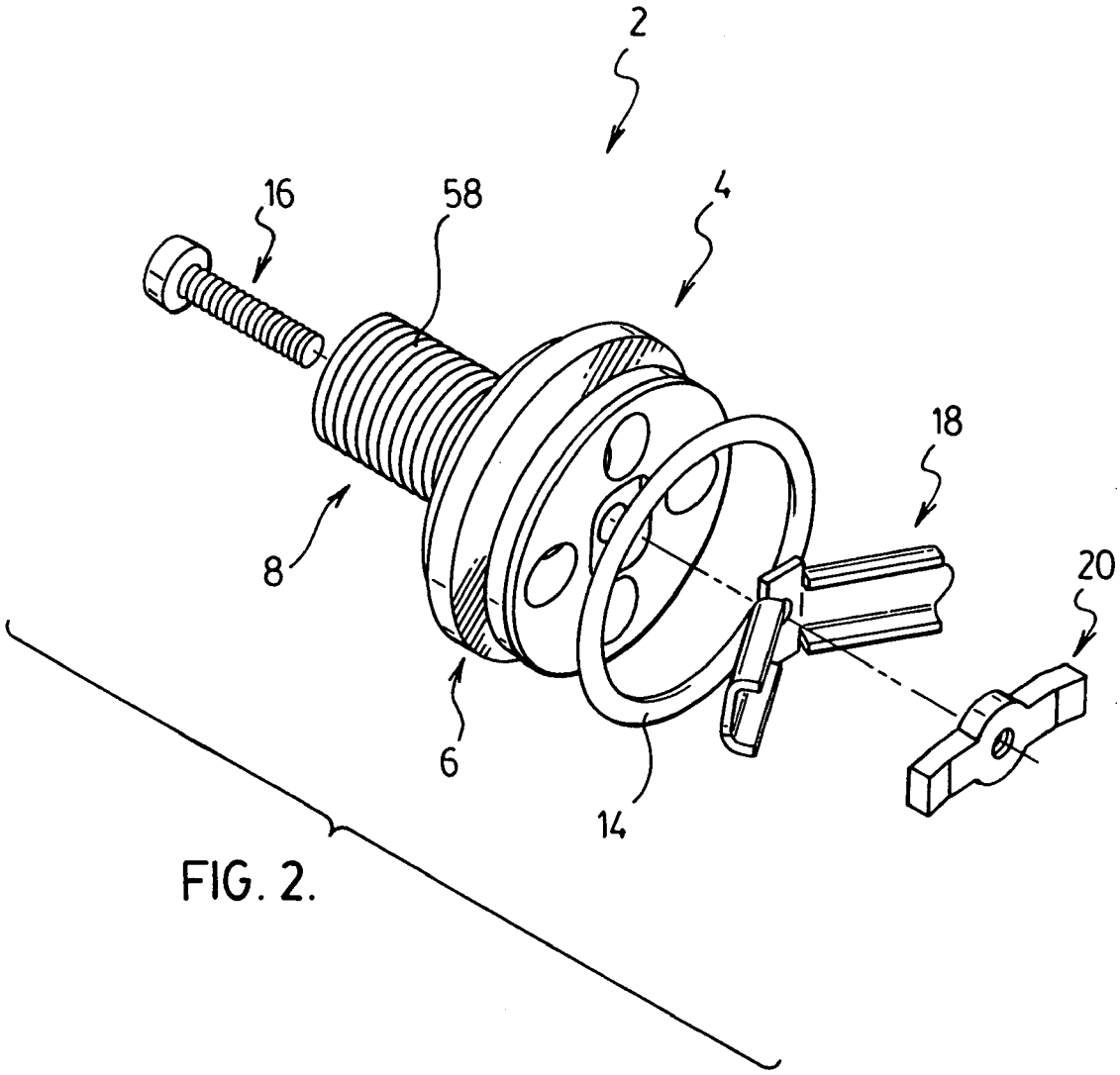
FIG. 2 shows an exploded view of the frost plug adapter assembly with the outer end having threads.

An alternative embodiment of the present invention is shown on FIG. 2, whereby the outer end 8 has threads 58 disposed around the outer circumference of the cylindrical outer end 8. The threads 58 enable the attachment of a hose having corresponding threads on an inner annular surface of an end of the hose (not shown).

Although this disclosure has described and illustrated certain preferred embodiments of the invention, it is also to be understood that the invention is not restricted to these particular embodiments rather, the invention includes all embodiments which are functional, or mechanical equivalents of the specific embodiments and features that have been described and illustrated herein.

It will be understood that, although various features of the invention have been described with respect to one or another of the embodiments of the invention, the various features and embodiments of the invention may be combined or used in conjunction with other features and embodiments of the invention as described and illustrated herein.

The invention claimed is:

1. A frost plug adapter assembly comprising:

a substantially cylindrical body having an inner end and an outer end, and having at least one internal cavity allowing a flow of fluid through the cylindrical body, the inner end having an end face with a recessed cavity, and a portion of the inner end having a diameter less than a diameter of a frost plug aperture, the portion of the inner end also having a seal to prevent fluid from exiting at an annular circumference of an inner side of the frost plug aperture when the portion of the inner end is secured within the frost plug aperture, whereby a portion of the cylindrical body has a diameter greater than the diameter of the frost plug aperture which is engagable with an annular circumference of an outer side of the frost plug aperture, the frost plug adapter assembly also having a locking element with a central portion sized to fit within the recessed cavity, the central portion having a hole therethrough and two arms integrally attached to the central portion and disposed opposite one another in a substantially co-planar alignment, each arm having two flanges, and each flange being disposed longitudinally along each side of each arm to provide channels, the two arms are each angled from a same side of the central portion at an oblique angle to a plane through the central portion whereby a distance between free ends of the arms before the portion of the inner end is inserted into the frost plug aperture is less than a diameter of the frost plug aperture, and the two arms being spreadable so that the distance between the free ends of the arms is greater than the diameter of the frost plug aperture after the portion of the inner end is inserted into the frost plug aperture, whereby, to secure the portion of the inner end of the cylindrical body within the frost plug aperture, a bolt is positionable through a longitudinal bore in the cylindrical body having a head of the bolt disposed at the outer end of the cylindrical body and the locking element is positioned on a threaded end of the bolt with the central portion disposed in the recess and the arms projecting away from the end face, and a wing nut is threadably secured to the threaded end whereby the wing nut has a central threaded nut and two wings integrally attached to the threaded nut and disposed opposite each other in a co-planar alignment, the wings being sized so as to be positionable within the channels of the arms whereby the tightening of the wing nut onto the threaded end of the bolt causes the free ends of the arms of the locking element to spread in a direction away from each other and towards the plane through the central portion to engage an inner circumference of the frost plug aperture.

2. The frost plug adapter assembly of claim 1, wherein the cylindrical body has four internal cavities spaced equidistant from each other on the end face of the inner end at an angle of 150 degrees to a longitudinal axis of the cylindrical body to allow a flow of fluid through the cylindrical body from the inner end to the outer end.

3. The frost plug adapter assembly of claim 1, wherein the outer end comprises a hose barb for engagement with a hose having an inner diameter equal to or greater than a diameter of the outer end.

4. The frost plug adapter assembly of claim 1, wherein the outer end is cylindrical and threaded.

5. The frost plug adapter assembly of claim 1 wherein the portion of the cylindrical body engagable with the outer circumferential rim of the frost plug aperture is an annular rib.

6. The frost plug adapter assembly of claim 1 wherein the seal comprises an O-ring gasket fitted within an annular recess circumscribing the inner end.

7. A frost plug adapter assembly comprising:

a substantially cylindrical body having an inner and outer end, and having at least one internal cavity allowing a flow of fluid through the cylindrical body;

the cylindrical body also having a portion of the inner end being sized to fit within a frost plug hole and having a rib engagable with an outer circumferential rim of the frost plug hole, and a recess positioned circumferentially on the cylindrical body between an end face of the inner end and the rib, an O-ring gasket positionable within the recess to form a seal when the inner end is engaged within the frost plug hole, the frost plug adapter assembly also having a positive capture apparatus comprising a locking element having a central portion with an aperture and two arms integrally attached to the central portion, the two arms being angled with a distance between free ends of the arms less than a diameter of the frost plug hole, and a bolt positionable through the cylindrical body and locking element and threaded to receive a wing nut, the wing nut being positionable within the flanges of the arms whereby the tightening of the wing nut onto the threaded bolt causes the free ends of the arms of the locking element to spread away from each other.

8. The frost plug adapter assembly of claim 7, wherein the outer end comprises a hose barb for engagement with a hose having an inner diameter equal to or greater than a diameter of the outer end.

9. The frost plug adapter assembly of claim 7, wherein the cylindrical outer end is threaded.

* * * * *